US006339279B1

(12) United States Patent
Miyamoto et al.

(10) Patent No.: US 6,339,279 B1
(45) Date of Patent: Jan. 15, 2002

(54) MIRROR-CARRYING FLASH LAMP

(75) Inventors: Makoto Miyamoto; Hiroyuki Amano, both of Shizuoka-ken (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/403,868

(22) PCT Filed: Apr. 30, 1998

(86) PCT No.: PCT/JP98/01967

§ 371 Date: Oct. 28, 1999

§ 102(e) Date: Oct. 28, 1999

(87) PCT Pub. No.: WO98/49714

PCT Pub. Date: Nov. 5, 1998

(30) Foreign Application Priority Data

Apr. 30, 1997 (JP) ..... 9-112891

(51) Int. Cl.[7] ..... H01J 5/16
(52) U.S. Cl. ..... 313/113; 313/46
(58) Field of Search ..... 313/113, 24, 44, 313/110, 112, 116, 46, 567, 634; 220/2.3 R, 2.3 A

(56) References Cited

U.S. PATENT DOCUMENTS

| | | | | |
|---|---|---|---|---|
| 3,502,929 A | * | 3/1970 | Richter | 313/113 |
| 3,766,421 A | | 10/1973 | Bonazoli et al. | 313/113 |
| 3,988,626 A | * | 10/1976 | Boudouris | 313/113 |
| 4,020,379 A | | 4/1977 | Manning | 313/220 |
| 4,179,037 A | | 12/1979 | Chan et al. | 220/2.3 R |
| 4,658,179 A | | 4/1987 | Roberts | 313/113 |
| 5,128,596 A | | 7/1992 | Shimazu et al. | 315/335 |

FOREIGN PATENT DOCUMENTS

| | | |
|---|---|---|
| JP | 48-33938 | 10/1973 |
| JP | 56-1746 | 1/1981 |
| JP | 56-50384 | 11/1981 |
| JP | 3-269949 | 12/1991 |
| JP | 7-120518 | 12/1995 |

* cited by examiner

*Primary Examiner*—Michael H. Day
*Assistant Examiner*—Joseph Williams
(74) *Attorney, Agent, or Firm*—Morgan, Lewis & Bockius LLP

(57) ABSTRACT

In a flash lamp in which an emission of an arc is generated by cooperation of a cathode (8), an anode (9), trigger probe electrodes (12, 13), and a sparker electrode (16) which are contained in an envelope (H) having a light projection window (4), and this emission is emitted from the light projection window (4), a mirror structure (20, 30, 40) is fixed at an inner end portion of an exhaust pipe (21, 34, 44) secured to the center of a stem (6) disposed at a bottom portion of the envelope (H). The mirror structure (20, 30, 40) comprises a mirror surface (24, 32, 42), contained in the envelope (H), facing the light projection window (4), and an exhaust path (26, 33, 43), formed at a position inside the mirror structure (20, 30, 40) separated from the mirror surface (24, 32, 42), communicating an exhaust port (**21*c*, 34*b*, 44*b*) of the exhaust pipe (21, 34, 44) and the exterior of the mirror structure (20, 30, 40**) to each other.

12 Claims, 7 Drawing Sheets

MIRROR-CARRYING FLASH LAMP

TECHNICAL FIELD

The present invention relates to a flash lamp equipped with a mirror, utilized as a light source for spectroscopy, emission analysis or the like, a stroboscopic light source, a light source for processing high-quality images, or the like.

BACKGROUND ART

A conventional technique in such a field is disclosed in Japanese Patent Publication No. HEI 7-120518. In the mirror-equipped flash lamp described in the above-mentioned publication, a cathode and an anode are disposed facing each other inside a bulb made of glass, the front end of a trigger probe electrode is located between the cathode and the anode, and an inert gas, such as xenon or argon, is encapsulated in the bulb. Further, for attaining high-output light, an ellipsoidal mirror is disposed inside the bulb, and the cathode is inserted in an opening formed in the bottom part of the ellipsoidal mirror, whereby an arc emission point is formed at a first focal point inside the ellipsoidal mirror. By the provision of such an ellipsoidal mirror inside the bulb, a high-output flash lamp is produced.

DISCLOSURE OF THE INVENTION

Due to the above-mentioned configuration, however, the following problem exists in the conventional mirror-equipped flash lamp.

Namely, since the bottom part of the ellipsoidal mirror is formed with an opening, light reflected by the ellipsoidal mirror forms a dark portion in its irradiation area under the influence of the opening, thus lacking uniformity. As a result, when irradiation light is to be introduced into a small-diameter fiber or slit, there have been cases where shortages or inconsistencies in quantity of light occur. While Japanese Patent Publication No. SHO 56-50384 also discloses a xenon lamp equipped with a mirror, the mirror in this case is also formed with an opening for receiving a pedestal for supporting an electrode.

For solving the above-mentioned problem, it is an object of the present invention, in particular, to provide a mirror-equipped flash lamp adapted to generate uniform light whose irradiation inconsistencies are very small.

The mirror-equipped flash lamp in accordance with the present invention is a flash lamp in which an arc emission is generated by cooperation of a cathode, an anode, a trigger probe electrode, and a sparker electrode which are contained in an envelope having a light projection window, and this emission is emitted from the light projection window; wherein a mirror structure is fixed at an inner end portion of an exhaust pipe secured to a center of a stem disposed at a bottom portion of the envelope; the mirror structure comprising a mirror surface, contained in the envelope, facing the light projection window, and an exhaust path, formed at a position inside the mirror structure separated from the mirror surface, communicating an exhaust port of the exhaust pipe and the exterior of the mirror structure to each other.

In this mirror-equipped flash lamp, when a predetermined voltage is applied between the cathode and the anode, and a trigger voltage is applied to the trigger probe electrode and the sparker electrode, a discharge occurs at the trigger probe electrode and, along with this discharge, a main discharge of an arc occurs between the cathode and the anode. The resulting emission is reflected by the mirror surface, so as to be emitted from the light projection window. Such a mirror surface is formed in the mirror structure, which is fixed at the inner end portion of the exhaust pipe. However, since the exhaust pipe is utilized for letting out the air from within the envelope and introducing an inert gas into the envelope, it is not allowed to close the exhaust port of the exhaust pipe facing the interior of the envelope. Therefore, the exhaust path for communicating the exhaust port of the exhaust pipe and the exterior of the mirror structure to each other is formed inside the mirror structure, and is disposed at a position separated from the mirror surface, i.e., at a position not cutting out the mirror surface. As a result, the mirror surface can be made as a complete surface without opening a hole therein. Also, post-processing such as boring a hole in the mirror surface is not necessary, the whole mirror surface can be used effectively as a reflecting surface, and the reflection characteristics inherent in the mirror surface can fully be utilized.

Preferably, in this case, the mirror structure comprises a cup-shaped mirror holder having a bottom part fixed at the inner end portion of the exhaust pipe; a mirror body, mounted in an opening of the mirror holder, having the mirror surface at a top face thereof; a mirror body support surface, extending toward inside the mirror holder at a part of an inner wall face of the mirror holder, for supporting the mirror body; and the exhaust path formed between a bottom face of the mirror body and a bottom face of the mirror holder. When such a configuration is employed, the mirror structure comprises a mirror holder and a mirror body which are separated from each other and thus can be made of different materials, whereby the manufacturing cost can be cut down. Also, a simple assembling operation of exchanging mirror bodies with respect to the mirror holder can provide the mirror structure with a desirable mirror surface (e.g., rounded mirror, parabolic mirror, ellipsoidal mirror, polyhedron mirror, or the like). Further, making the mirror holder and the mirror body separate from each other is advantageous in that, since the mirror body is supported by the mirror body support surface such that the bottom faces of the mirror holder and mirror body do not come into contact with each other when the mirror body is mounted to the mirror holder, a space can positively be formed between the bottom faces of the mirror holder and mirror body, and this space can effectively be used as the exhaust path, whereby the exhaust path can easily be formed at a position separated from the mirror surface, i.e., at a position not cutting out the mirror surface. Also, as the exhaust path is disposed at this position, the exhaust port of the exhaust pipe and the exterior of the mirror structure can easily be communicated to each other. For example, a simple drilling process for only providing a side wall or bottom wall of the mirror holder with a hole communicating with the exhaust path can produce a gas port in the mirror structure.

Also, it is preferred that a mirror body fixing ring abutting against a peripheral edge in the top face of the mirror body and abutting against the inner wall face of the mirror holder be further provided. When such a configuration is employed, at the time of assembling the mirror structure, the mirror body can be constrained by the mirror body fixing ring as the latter is introduced into the mirror holder after the mirror body is mounted into the opening of the cup-shaped mirror holder, whereby the mirror body can be secured simply and reliably in the mirror holder.

Further, it is preferred that the mirror holder reduce its diameter on the bottom face side thereof at a part of the side wall thereof, so as to provide an inner wall face of the mirror holder with the mirror body support surface. When such a configuration is employed, at the time of assembling the mirror structure, even if the mirror body is simply mounted into the opening of the mirror holder, the bottom faces of the mirror holder and mirror body can be kept from coming into contact with each other, whereby the exhaust path can be secured easily.

Further, it is preferred that the mirror body be made of glass. When such a configuration is employed, in the forming of the mirror surface, the surface processing is easier than that in metals such as aluminum, thereby yielding a surface which not only can be made at a lower manufacturing cost but also has a low surface roughness and high surface precision. Also, when aluminum is vapor-deposited on a glass surface to form a mirror surface, a firm specular surface would be formed on the glass surface, whereby a highly durable mirror surface can be obtained.

Further, it is preferred that a gas port of the exhaust path is formed in a flat bottom wall of the mirror holder so as to penetrate therethrough. When such a configuration is employed, a drilling process for forming the gas port in the mirror holder becomes easy.

Further, the mirror surface preferably constitutes a rounded mirror. When such a configuration is employed, it is not necessary to form an opening at the bottom part thereof as in the case of an ellipsoidal mirror, whereby light-collecting efficiency can be improved.

Further, it is preferred that an arc emission part be disposed at a focal position of the mirror surface. Employing such a configuration in a rounded mirror enables the mirror surface to reliably collect light.

Also, it is preferred that the mirror structure comprise a block body, secured at the inner end portion of the exhaust pipe, having the mirror surface integrally formed at a top face thereof and the exhaust path therewithin. When such a configuration is employed, no additional step of assembling the mirror structure is needed, whereby the working efficiency of assembling the flash lamp would improve.

Further, it is preferred that, at a center of the block body in the bottom face thereof, a pipe insertion hole, extending in a center axis direction of the block body, for receiving the inner end portion of the exhaust pipe be provided, and that the exhaust pipe be secured to the block body with a screw. When such a configuration is employed, the assembling of the block body and the exhaust pipe to each other can be carried out easily and reliably.

Further, it is preferred that a gas port of the exhaust path be formed at a peripheral side face of the block body. When such a configuration is employed, a simple drilling process can communicate the pipe insertion hole and the exhaust path to each other at the time of forming the block body with the gas port.

Further, the mirror surface preferably constitutes a rounded mirror. When such a configuration is employed, it is not necessary to form an opening at the bottom part thereof as in the case of an ellipsoidal mirror, whereby light-collecting efficiency can be improved.

Further, it is preferred that an arc emission part be disposed at a focal position of the mirror surface. Employing such a configuration in a rounded mirror enables the mirror surface to reliably collect light.

BEST MODE FOR CARRYING OUT THE INVENTION

In the following, preferred embodiments of the mirror-equipped flash lamp in accordance with the present invention will be explained in detail with reference to the drawings.

Figure 1:
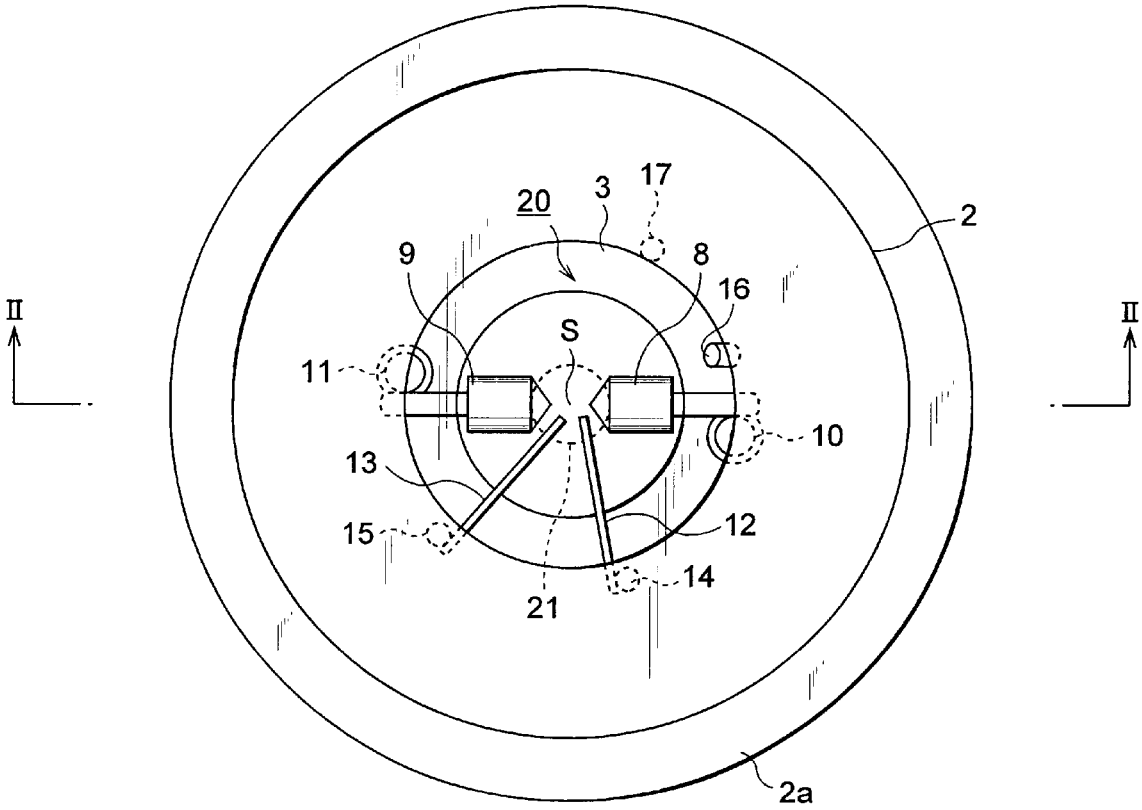
FIG. 1 is a plan view of a mirror-equipped flash lamp in accordance with the present invention.
Figure 2:
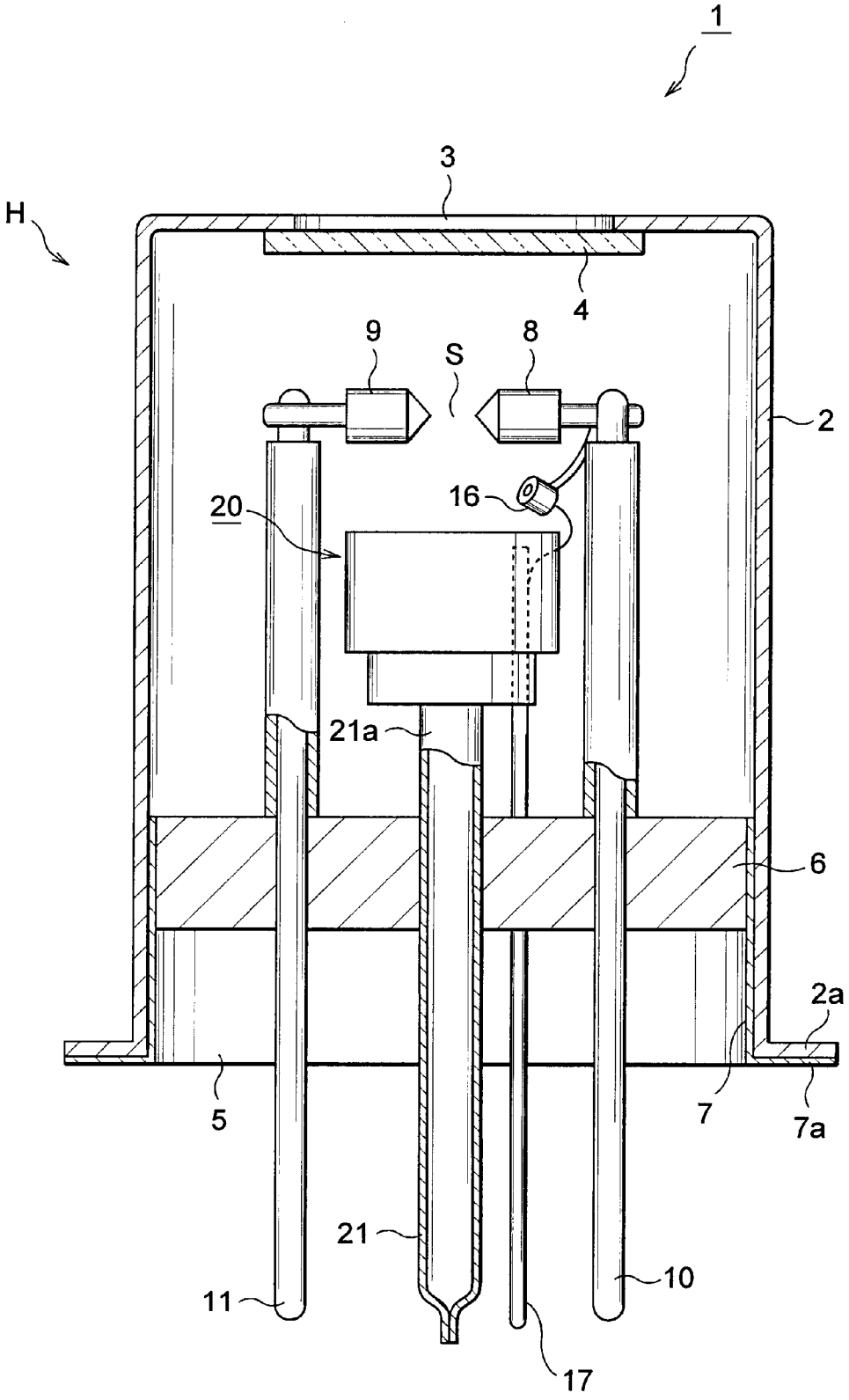
FIG. 2 is a sectional view taken along the line II—II of FIG. 1.

FIG. 1 is a plan view showing the appearance of a mirror-equipped flash lamp in accordance with the present invention, whereas FIG. 2 is a sectional view taken along the line II—II of FIG. 1. The mirror-equipped flash lamp 1 shown in these drawings has a cylindrical side tube 2 made of covar metal, a circular first opening 3 is formed at one end of the side tube 2, and a light projection window 4 made of sapphire glass is secured to the side tube 2 so as to close the first opening 3. Further, a circular second opening 5 is formed at the other end of the side tube 2, and a disk-shaped stem 6 made of covar glass is secured to the side tube 2 so as to close the second opening 5. Also, a cylindrical stem holder 7 made of covar metal is fused to the peripheral side face of the stem 6, so that the flange portion 7*a* of the stem holder 7 and the flange 2*a* of the side tube 2 can be arc-welded to each other, thereby making it easier for the stem 6 and the side tube 2 to be secured to each other. Thus, a hermetic type envelope H of the flash lamp 1 is constructed.

Further, a cathode 8 and an anode 9 which are adapted to cause an arc discharge are disposed inside the envelope H, whereas these electrodes 8, 9 are secured to the stem 6 with the aid of stem pins 10, 11. Also, inside the envelope H, two trigger probe electrodes 12, 13 are disposed such that their front ends are located between the cathode 8 and the anode 9, whereas these electrodes 12, 13 are secured to the stem 6 with the aid of stem pins 14, 15. Further, a sparker electrode 16 is disposed inside the envelope H, and is secured to the stem 6 with the aid of a stem pin 17. The inside of the envelope H is kept at a high pressure, with xenon gas as an example of the inert gas being encapsulated therein.

When a predetermined voltage is applied between the cathode 8 and the anode 9 by way of the stem pins 10, 11, and a trigger voltage is applied to the trigger probe electrodes 12, 13 and the sparker electrode 16 by way of the stem pins 14, 15, 17, a discharge occurs at the trigger probe electrodes 12, 13 and, along with this discharge, a main discharge of an arc occurs between the cathode 8 and the anode 9. The emission at this time is reflected by a mirror structure 20 which will be explained later, so as to be emitted from the light projection window 4.

This mirror structure 20 is disposed among the cathode 8, the anode 9, and the stem 6, so as to be positioned directly below an arc emission part S formed between the cathode 8 and the anode 9. For enabling such an arrangement, the mirror structure 20 is fixed at an inner end portion 21*a* of an exhaust pipe 21, made of covar metal, secured to the disk-shaped stem 6. Here, this exhaust pipe 21 extends in the tube axis direction so as to penetrate through the center of the stem 6.

Figure 3:
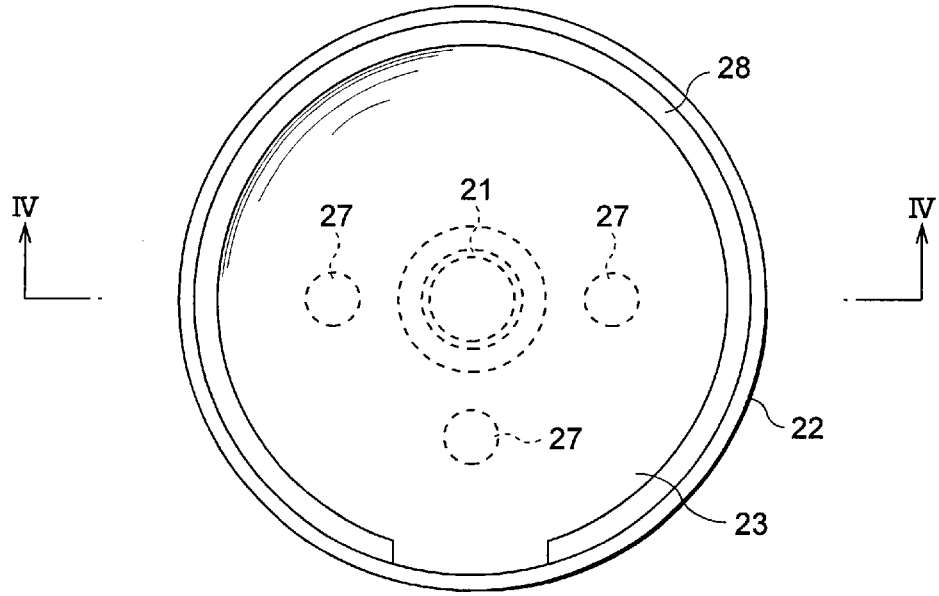
FIG. 3 is a plan view of a mirror structure employed in the flash lamp shown in FIG. 1.
Figure 4:
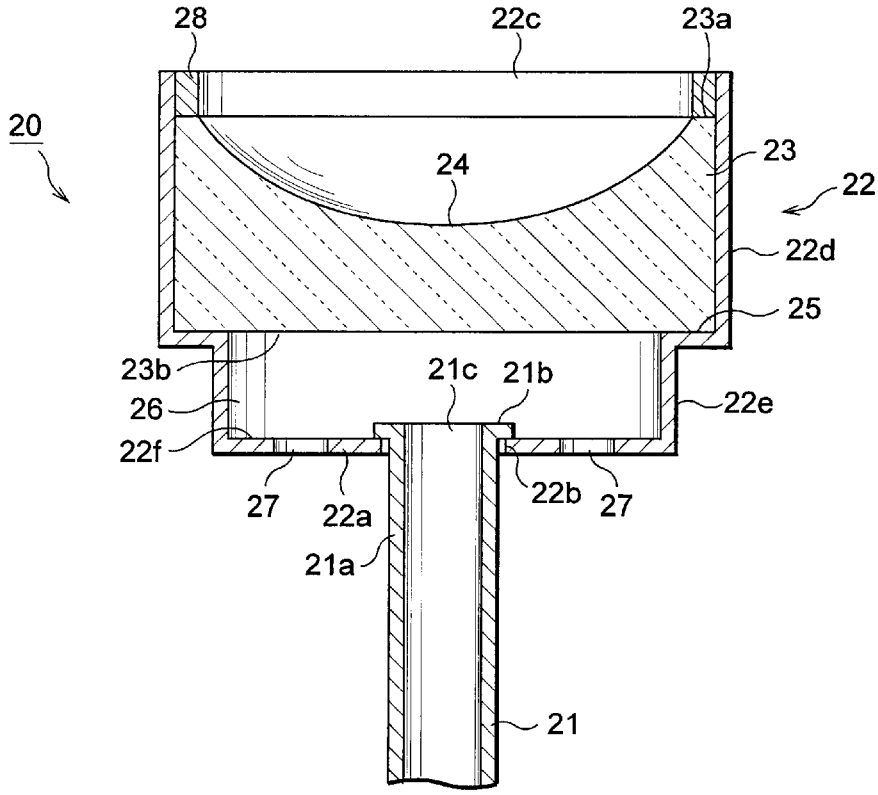
FIG. 4 is a sectional view taken along the line IV—IV of FIG. 3.
Figure 5:
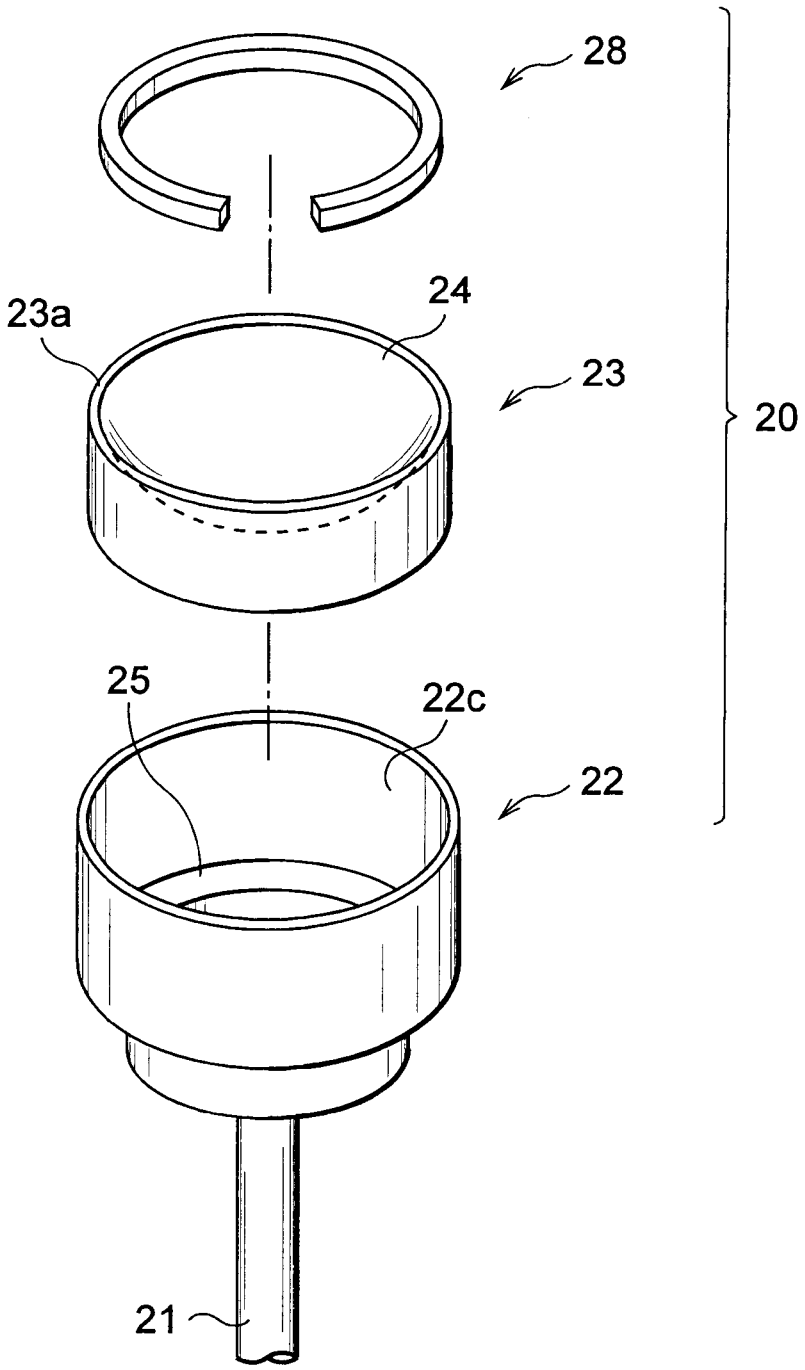
FIG. 5 is an exploded perspective view of the mirror structure.

As shown in FIGS. 3 to 5, the mirror structure 20 is constructed as a dividable type and has a cup-shaped mirror holder 22 made of stainless, whereas this mirror holder 22 is formed like a cylinder having a bottom wall 22*a* with a pipe insertion hole 22*b*, formed at the center thereof, for receiving the exhaust pipe 21. A flange portion 21*b* is formed at an end part of the exhaust pipe 21, whereby the inner end portion 21*a* of the exhaust pipe 21 and the bottom wall 22*a* of the mirror holder 22 can be arc-welded to each other when the flange portion 21*b* is caused to abut against the bottom wall 22*a* of the mirror holder 22. Thus, securing the exhaust pipe 21 to the center of the mirror holder 22 enables a centering structure for a mirror surface 24 which will be mentioned later.

Further, a disk-shaped mirror body 23 is closely fitted in the mirror holder 22 so as to be concentric therewith. This mirror body 23 is made of a glass material and has such a diameter that it can be inserted into the mirror holder 22 from the opening 22*c* thereof. Also, the top face of the mirror body 23 is formed with the mirror surface 24, facing the light projection window 4, shaped into a rounded mirror while constituting a concave mirror. Here, the rounded mirror refers to a mirror made of a curved surface with a constant radius of curvature having a single focal point. This mirror surface 24 is formed by vapor-depositing aluminum onto a glass surface. When glass is thus employed in the mirror body 23, in the forming of the mirror surface 24, the surface processing is easier than that in metals such as aluminum, thereby yielding the mirror surface 24 which not only can be made at a lower manufacturing cost but also has a low surface roughness and high surface precision. Also, when aluminum is vapor-deposited on the glass to form the mirror surface 24, a firm specular surface would be formed on the glass, whereby the highly durable mirror surface 24 can be obtained. Here, the mirror body 23 may also be made of metals such as aluminum, copper, and the like.

Also, a part of the side wall 22*d* of the mirror holder 22 is caused to reduce its diameter on the bottom wall 22*a* side by drawing, thus yielding a reduced diameter portion 22*e*, whereby an annular mirror body support surface 25 extending inward is formed in the inner wall face of the mirror holder 22. Hence, when the bottom face 23*b* of the mirror body 23 abuts against the mirror body support surface 25, the bottom face 22f of the mirror holder 22 and the bottom face 23*b* of the mirror body 23 are kept from coming into contact with each other, and the exhaust port 21*c* of exhaust pipe 21 is prevented from being closed by the mirror body 23.

Thus, a columnar space can be formed between the bottom face 22*f* of the mirror holder 22 and the bottom face 23*b* of the mirror body 23. As this space is effectively utilized as an exhaust path 26, the latter is easily formed at a position separated from the mirror surface 24, i.e., at a position not cutting out the mirror surface 24. As a result, the mirror surface 24 can be made as a complete surface without opening a hole therein. Therefore, post-processing such as boring a hole in the mirror surface 24 is not necessary, the whole mirror surface 24 can be used effectively as a reflecting surface, and the reflection characteristics inherent in the mirror surface 24 can fully be utilized.

Further, three gas ports 27 of the exhaust path 26 are formed in the bottom wall 22*a* of the mirror holder 22 so as to surround the exhaust pipe 21, each gas port 27 being formed in the flat bottom wall 22*a* by drilling. Thus, the exhaust path 26 communicates the exhaust port 21*c* of the exhaust pipe 21 and the exterior of the mirror structure 20 to each other. As a consequence, by use of the exhaust pipe 21, after the air inside the envelope H is let out under vacuum, the inside of the envelope H can be filled with an inert gas such as xenon gas. After xenon gas is encapsulated, an outer end portion of the exhaust pipe 21 is sealed.

Here, as means for securing the mirror body 23 inside the mirror holder 22, a C-shaped mirror body fixing ring 28 is utilized. This mirror body fixing ring 28 is made of a stainless material, and has such a diameter that it can be mounted in the opening 22*c* of the mirror holder 22. Hence, when the mirror body 23 is mounted into the mirror holder 22 from the opening 22*c* thereof, as the mirror body fixing ring 28 is introduced into the mirror holder 22, the mirror body fixing ring 28 abuts against the peripheral edge 23*a* in the top face of the mirror body 23 and the inner wall face of the mirror holder 22. Then, as the mirror body fixing ring 28 and the mirror holder 22 are spot-welded to each other, the mirror body 23 is firmly secured in the mirror holder 22 by cooperation of the mirror body fixing ring 28 and the mirror body support surface 25. Here, the mirror body 23 can also be secured if an unshown pawl is formed at a top portion of the mirror holder 22 and bent inward. Also, if the mirror body fixing ring 28 is provided with a spring force, there will be cases where it is not necessary for the mirror body fixing ring 28 and the mirror holder 22 to be welded together.

Since the rounded mirror is employed as the mirror surface 24, thus configured mirror structure 20 can cause the arc emission part S (see FIG. 2) located between the cathode 8 and the anode 9 to align with the focal position (center of curvature) of the mirror surface 24, thus allowing the mirror surface 24 to reliably collect light.

A modified example of the mirror structure will now be explained.

Figure 6:
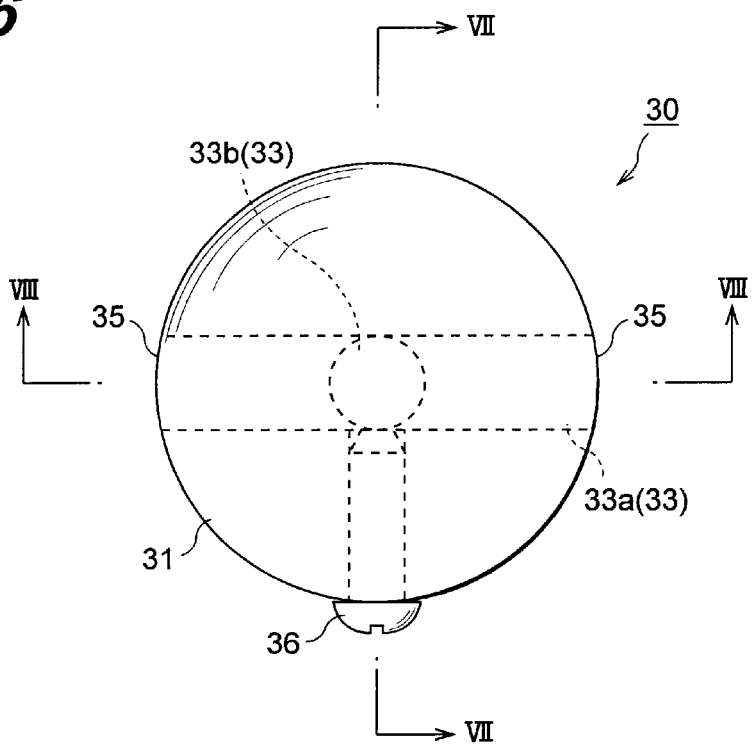
FIG. 6 is a plan view showing a modified example of the mirror structure.
Figure 7:
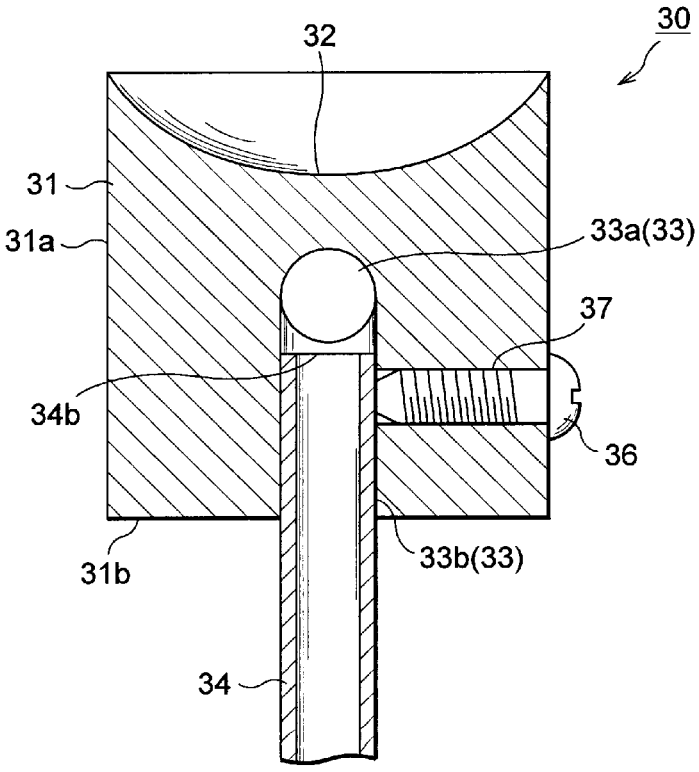
FIG. 7 is a sectional view taken along the line VII—VII of FIG. 6.
Figure 8:
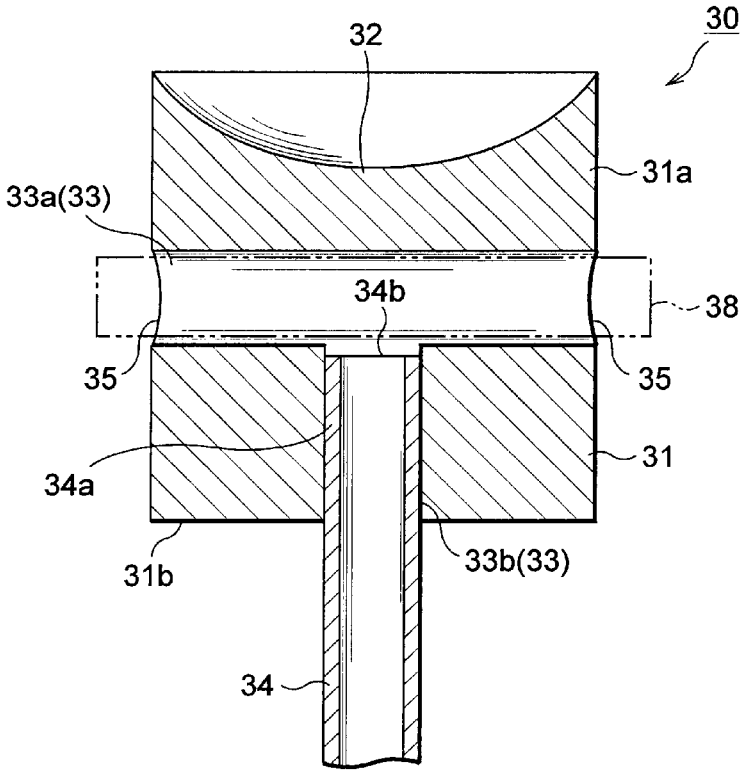
FIG. 8 is a sectional view taken along the line VIII—VIII of FIG. 6.

As shown in FIGS. 6 to 8, another mirror structure 30 is constituted by a columnar block body 31 made of aluminum, a mirror surface 32 constituting a rounded mirror is formed at the top face of the block body 31, and the mirror surface 32 is finished as a specular surface by vapor deposition of aluminum. Inside the block body 31, an exhaust path 33 is formed at a position separated from the mirror surface 32, i.e., at a position not cutting out the mirror surface 32. This exhaust path 33 comprises therewithin a first exhaust path 33*a* diametrically extending like a line so as to penetrate through the peripheral side face 31*a* of the block body 31, and a second exhaust path 33*b* extending in the center axis direction so as to penetrate through the bottom face 31*b* of the block body 31, which are formed by drilling. Namely, the exhaust path 33 is formed like letter T within the block body 31.

Also, the first exhaust path 33*a* has a pair of gas ports 35 formed on the right and left side of the peripheral side face 31*a*, whereas the second exhaust path 33*b* is utilized as a pipe insertion hole. This pipe insertion hole 33*b* has such a diameter that an exhaust pipe 34 can be tightly fitted therein, and aligns with the center axis of the block body 31 at its center in the bottom face 31*b* thereof, thus enabling a centering structure for the mirror surface 32. Further, a screw hole 37 is formed so as to extend from the peripheral side face 31*a* to the pipe insertion hole 33*b*.

Hence, a rod-shaped spacer 38 slightly thinner than the first exhaust path 33*a* is inserted into the latter so as not to close an exhaust port 34*b* of the exhaust pipe 34. Thereafter, the exhaust pipe 34 is inserted into the pipe insertion hole 33*b* of the block body 31, and a screw 36 is threaded into the screw hole 37. As a result, the block body 31 is reliably secured to the inner end portion 34*a* of the exhaust pipe 34, and the exhaust port 34*b* of the exhaust pipe 34 and the exterior are communicated to each other by way of the exhaust path 33. Here, the exhaust pipe 34 may be secured to the block body 31 by welding or the like after being inserted into the pipe insertion hole 33*b*. Also, since the rounded mirror is employed as the mirror surface 32, the arc emission part S (see FIG. 2) located between the cathode 8 and the anode 9 aligns with the focal position (center of curvature) of the mirror surface 32, thus allowing the mirror surface 32 to reliably collect light.

Another modified example of the mirror structure will now be explained.

Figure 9:
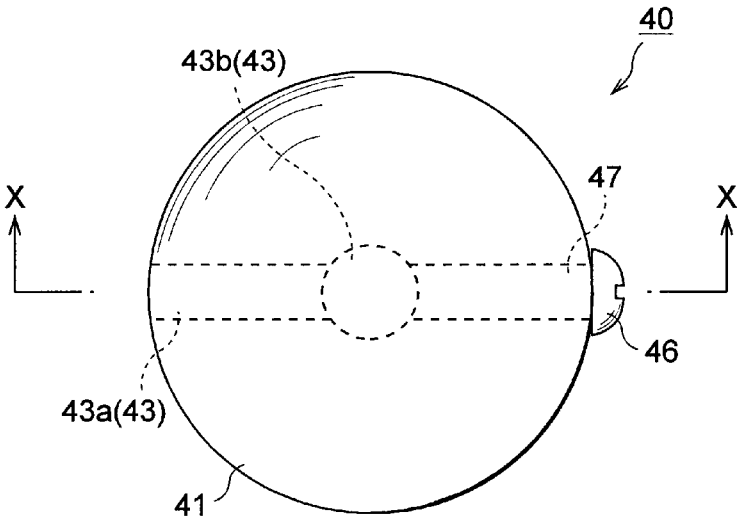
FIG. 9 is a plan view showing another modified example of the mirror structure.
Figure 10:
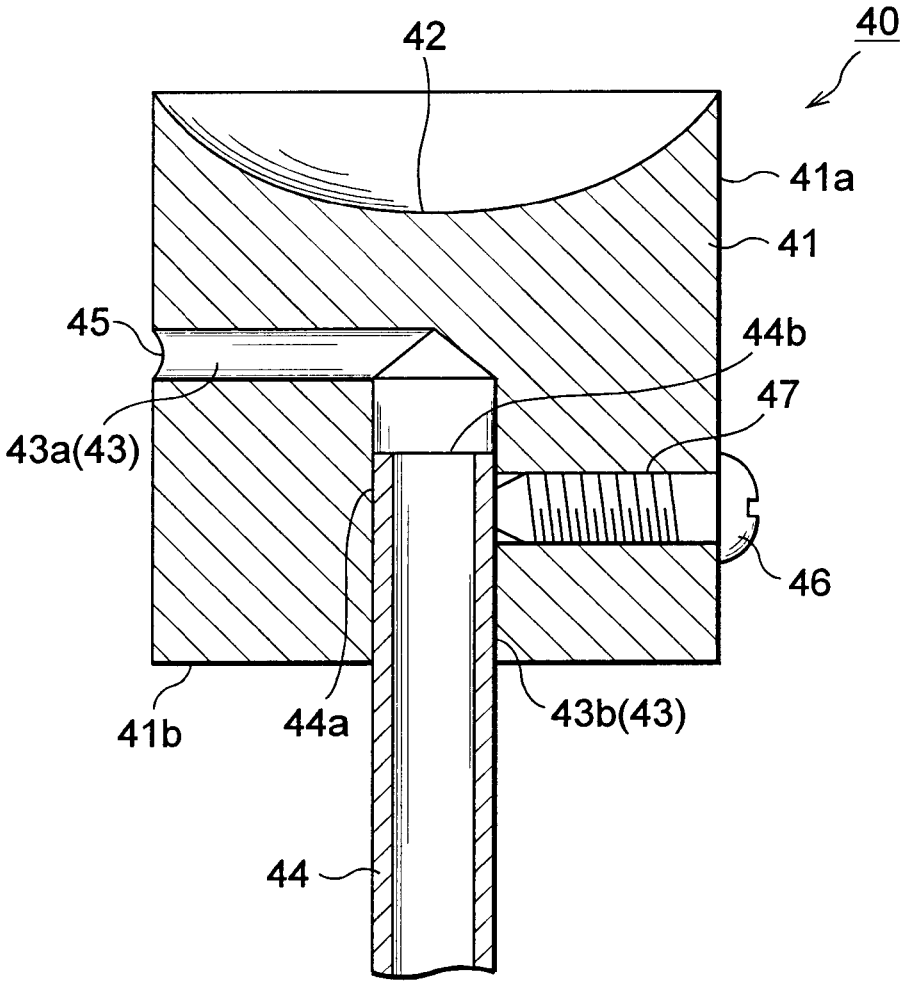
FIG. 10 is a sectional view taken along the line X—X of FIG. 9.

As shown in FIGS. 9 and 10, still another mirror structure 40 is constituted by a columnar block body 41 made of aluminum, a mirror surface 42 constituting a rounded mirror is formed at the top face of the block body 41, and the mirror surface 42 is finished as a specular surface by vapor deposition of aluminum. Inside the block body 41, an exhaust path 43 is formed at a position separated from the mirror surface 42, i.e., at a position not cutting out the mirror surface 42. This exhaust path 43 comprises therewithin a first exhaust path 43*a* radially extending like a line from the peripheral side face 41*a* of the block body 41 so as to be cut into the center of the block body 41, and a second exhaust path 43*b* extending in the center axis direction so as to penetrate through the bottom face 41*b* of the block body 41, which are formed by drilling. Namely, the exhaust path 43 is formed like letter L within the block body 41.

Also, the first exhaust path 43*a* has one gas port 45 at the peripheral side face 41*a* thereof, whereas the second exhaust path 43*b* is utilized as a pipe insertion hole. This pipe insertion hole 43*b* has such a diameter that an exhaust pipe 44 can be tightly fitted therein, and aligns with the center axis of the block body 41 at its center in the bottom face 41*b* thereof, thus enabling a centering structure for the mirror surface 42. Further, a screw hole 47 is formed so as to extend from the peripheral side face 41*a* to the pipe insertion hole 43*b*.

After the exhaust pipe 44 is inserted into the pipe insertion hole 43*b* of the block body 41, a screw 46 is threaded into the screw hole 47, whereby the block body 41 is reliably secured to the inner end portion 44*a* of the exhaust pipe 44, and the exhaust port 44*b* of the exhaust pipe 44 and the exterior are communicated to each other by way of the exhaust path 43. Here, the exhaust pipe 44 may be secured to the block body 41 by welding or the like after being inserted into the pipe insertion hole 43*b*.

The present invention is not limited to the above-mentioned various embodiments. For example, the mirror surfaces 24, 32, 42 are not restricted to rounded mirrors, but may be parabolic mirrors, ellipsoidal mirrors, or polyhedron mirrors.

As a consequence of the foregoing configuration, the mirror-equipped flash lamp in accordance with the present invention can yield the following effects. Namely, since a mirror structure is fixed at an inner end portion of an exhaust pipe, while the mirror structure comprises a mirror surface, contained in an envelope, facing a light projection window, and an exhaust path formed at a position inside the mirror structure separated from the mirror surface, a structure in which the mirror surface is free of holes can be attained, and uniform light can be generated with very small irradiation inconsistencies.

INDUSTRIAL APPLICABILITY

The mirror-equipped flash lamp in accordance with the present invention can be utilized as a light source for spectroscopy, emission analysis or the like, a stroboscopic light source, a light source for processing high-quality images, or the like.

What is claimed is:

1. A flash lamp in which an arc emission between an anode and a cathode is reflected by a mirror surface and is emitted from a window of an envelope, said flash lamp comprising:

an exhaust pipe penetrating through a stem of said envelope so as to project inside said envelope, and a mirror structure, supported by said exhaust pipe, having said mirror surface positioned between an inner end portion of said exhaust pipe and said window, and an exhaust path, separated from said mirror surface, for communicating from said exhaust pipe to the inside of said envelope.

2. A flash lamp according to claim 1, wherein said mirror structure comprises:

a cup-shaped mirror holder having a bottom part fixed at said inner end portion of said exhaust pipe;

a mirror body, mounted in an opening of said mirror holder, having said mirror surface at a top face thereof;

a mirror body support surface, extending toward inside said mirror holder at a part of an inner wall face of said mirror holder, for supporting said mirror body; and said exhaust path formed between a bottom face of said mirror body and a bottom face of said mirror holder.

3. A flash lamp according to claim 2, further comprising a mirror body fixing ring abutting against a peripheral edge in the top face of said mirror body and abutting against said inner wall face of said mirror holder.

4. A flash lamp according to claim 2, wherein said mirror holder reduces a diameter on the bottom face side thereof at a part of a side wall thereof, so as to provide an inner wall face of said mirror holder with said mirror body support surface.

5. A flash lamp according to claim 2, wherein said mirror body is made of glass.

6. A flash lamp according to claim 2, wherein a gas port of said exhaust path is formed in a flat bottom wall of said mirror holder so as to penetrate therethrough.

7. A flash lamp according to claim 1, wherein said mirror structure comprises:

a block body, secured at said inner end portion of said exhaust pipe, having said mirror surface integrally formed at a top face thereof and said exhaust path therewithin.

8. A flash lamp according to claim 7, wherein a pipe insertion hole, extending in a center axis direction of said block body, for receiving said inner end portion of said exhaust pipe is provided at a center of said block body in a bottom face thereof, said exhaust pipe being secured to said block body with a screw.

9. A flash lamp according to claim 8, wherein a gas port of said exhaust path is formed at a peripheral side face of said block body.

10. A flash lamp comprising:

an anode and a cathode causing an arc emission therebetween;

an envelope accommodating said anode and cathode;

an exhaust pipe penetrating through a stem of said envelope; and a mirror structure supported by said exhaust pipe, said mirror structure being arranged in and separated from an inner surface of said envelope, said mirror structure having a mirror surface at its end.

11. The flash lamp according to claim 10, said mirror structure having a cavity between said mirror surface and the end of said exhaust pipe inside the envelope.

12. The flash lamp according to claim 11, wherein said mirror structure has an opening communicating from said cavity to outside said mirror structure.

* * * * *